US005346322A

United States Patent [19]

Okamori

[11] Patent Number: 5,346,322

[45] Date of Patent: Sep. 13, 1994

[54] PRINTING DEVICE HAVING PAPER FEED CONTROL

[75] Inventor: Shuhei Okamori, Nagoya, Japan

[73] Assignee: Brother Kogyo Kabushiki Kaisha, Aichi, Japan

[21] Appl. No.: 71,376

[22] Filed: Jun. 3, 1993

Related U.S. Application Data

[63] Continuation of Ser. No. 821,330, Jan. 13, 1992, abandoned, and Ser. No. 513,825, Apr. 24, 1990, abandoned.

[30] Foreign Application Priority Data

Apr. 24, 1989 [JP] Japan ..... 1-104157
Dec. 26, 1989 [JP] Japan ..... 1-340125

[51] Int. Cl.[5] ..... B41J 29/44

[52] U.S. Cl. ..... 400/709; 400/621; 400/630; 400/707.1; 400/708

[58] Field of Search ..... 400/630, 621, 621.1, 400/621.2, 632, 706, 707.1, 708, 709

[56] References Cited

U.S. PATENT DOCUMENTS 4,229,113 10/1980 Anderson et al. ..... 400/606
4,360,279 11/1982 Sugiura ..... 400/605
4,693,621 9/1987 Kawaguchi ..... 400/636.1
4,702,632 10/1987 Taketani ..... 400/551
4,780,012 10/1988 Kikuchi et al. ..... 400/625
4,861,175 8/1989 Hori et al. ..... 400/279
4,934,845 6/1990 Kato ..... 400/630
4,960,336 10/1990 Brooks et al. ..... 400/583
4,968,165 11/1990 Karube et al. ..... 400/630

FOREIGN PATENT DOCUMENTS

0183413A2 11/1985 European Pat. Off. .
0288089A2 4/1988 European Pat. Off. .
0297486A2 6/1988 European Pat. Off. .
0312201A1 8/1988 European Pat. Off. .
0312407A2 10/1988 European Pat. Off. .
57016774 1/1982 Japan .

*Primary Examiner*—Edgar S. Burr
*Assistant Examiner*—John S. Hilten
*Attorney, Agent, or Firm*—Kane, Dalsimer, Sullivan, Kurucz, Levy, Eisele and Richard

[57] ABSTRACT

In a printing device, provided are means for setting a print start position in the printing form, and means for automatically feeding the printing sheet till the set print start position is located at a printing head. Thus, data can be printed in the desired position without complicated operations.

In other words, the print start position of the continuous-form printing sheet can be securely and quickly conducted with simple operations.

17 Claims, 4 Drawing Sheets

PRINTING DEVICE HAVING PAPER FEED CONTROL

This application is a continuation of application Ser. No. 07/821,330, filed Jan. 13, 1992, now abandoned, and Ser. No. 07/513,825, filed Apr. 24, 1990, now abandoned.

BACKGROUND OF THE INVENTION

The present invention relates to a printing device capable of employing at least a continuous-form printing sheet, more particularly to a printing device which is equipped with a mechanism for setting the start position of the printing operation at a desired position on the printing sheet.

Conventionally, when setting the print start position to a desired position on a continuous-form printing sheet in this type of printer, the following operation sequence should be conducted. First, while the printing sheet is set in the sheet feed mechanism, by pressing the sheet feed switch, the sheet feed motor is driven so as to feed the printing sheet toward a printing head. In addition, by operating a line feed switch, the sheet is fed pulse by pulse, which is outputted every line feed switch operation, until the print start position on the printing sheet accords with the start position setting mark located near to the print head. When the printer detects that the print start position accords with the setting mark, it receives the print data from the host computer and start printing the data. When the print start position should be adjusted, the printer suspends the print operation and repeats the above operation.

However, with the printer described above, while an operator visually checks the print start position, he or she should press the required switch. Thus, occasionally, the print start position differs from the desired position. It is difficult for the operator to find the most suitable position.

SUMMARY OF THE INVENTION

It is therefore an object of the invention to provide an improved printing device capable of setting a print start position from which a printing operation is executed is accurately located at a printing head by means of a simple operation.

For this purpose, according to the present invention, there is provided a printing device, capable of employing at least a continuous-form printing sheet successively having a plurality of printing forms along a predetermined direction, comprising a printing unit for executing a printing operation on the printing sheet, and a sheet feeding unit for feeding the printing sheet along said predetermined direction at least toward a position at which said printing unit is located, said printing device further comprising:

print start position setting means for setting a print start position in the printing form from which a printing operation is started;

controlling means for controlling said sheet feeding unit so as to feed the printing sheet toward said printing unit;

detecting means, provided upstream side of said printing unit in said predetermined direction, for detecting whether a predetermined position on the printing sheet fed toward said printing unit reaches a point at which said detecting means is provided;

another controlling means for controlling said sheet feeding unit so as to further feed the printing sheet till the print start position set by said print start position setting means is located at said printing unit;

discriminating means for discriminating whether said predetermined position on the printing sheet is located downstream side of said detecting means in said predetermined direction; and third controlling means for controlling said sheet feeding unit so as to reversely feed the printing sheet till said predetermined position on the printing sheet is located upstream side of said detecting means in case that it is discriminated by said discriminating means that said predetermined position is located downstream side of said detecting means.

DESCRIPTION OF THE ACCOMPANYING DRAWINGS

DESCRIPTION OF THE EMBODIMENTS

Referring to the accompanying drawings, an embodiment of the present invention will be described hereinafter.

Figure 1:
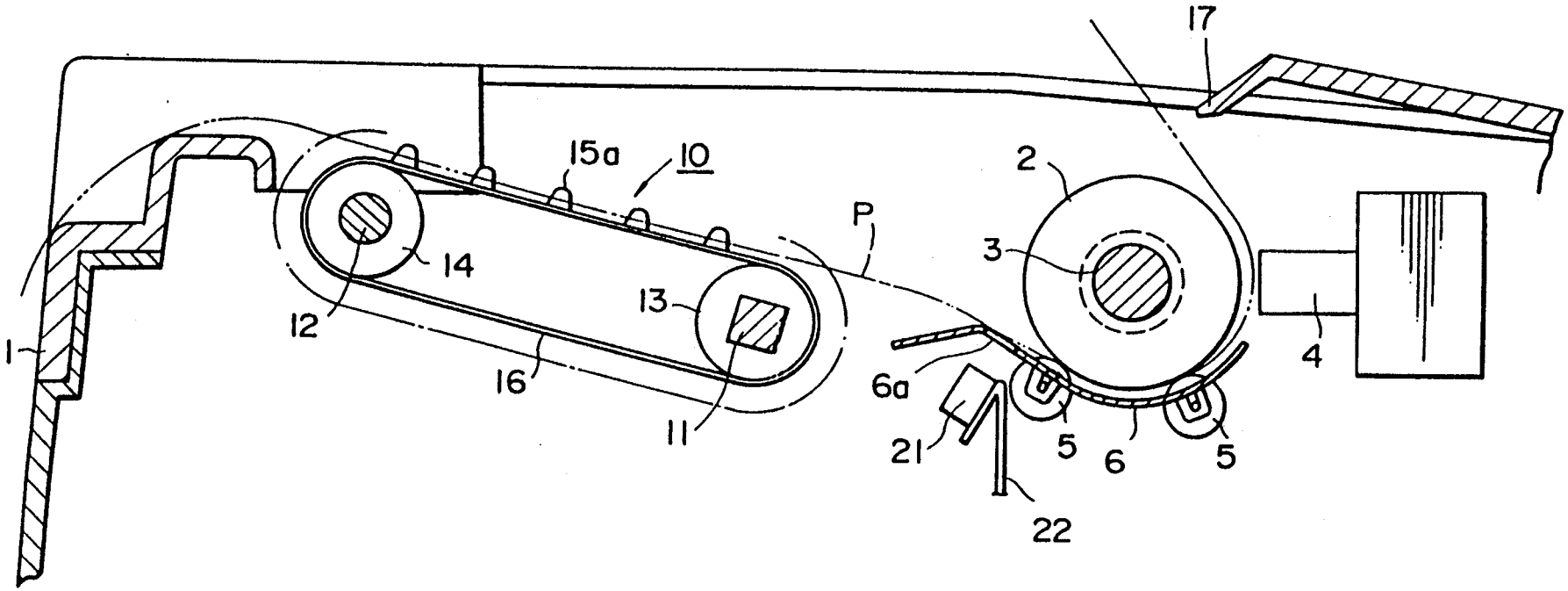
FIG. 1 is a sectional view showing the principal section of the printing device of the embodiment according to the present invention.

FIG. 1 is a sectional view of one side of a principal section of the printing device according to the present invention. In the drawing, in a sheet feed path in a printer frame 1, a platen 2 extended in the breadth direction of the sheet is rotatably supported by a platen shaft 3. At the front, i.e., on the right side of the drawing, of the platen 2, a print head 4 for reciprocatively moving along the platen 2 to print data on a continuous-form printing sheet "P" is disposed. On the downstream side of the platen 2, a sheet guide member 6 for rotatably supporting a plurality of sheet support rollers 5 is disposed along the platen 2. On the other hand, on the upstream side of the platen 2, a cutter 17 for cutting a part of the tractor feed sheet "P" being sent is disposed.

On the upstream side, i.e., the left side of the drawing, of the platen 2 on the feed path of the printing sheet "P", a pair of pin tractors 10, only one side is shown, are disposed. The pin tractors 10 are extended in parallel with the platen 2 and supported on a transfer shaft 11 and a guide shaft 12 rotatably supported to the printer frame 1 so that the movement of the printing sheet "P" can be adjusted in the breadthwise direction. Each of the pin tractors 10 is provided with a drive pulley 13 rotatably associated with the transfer shaft 11 and a follower pulley 14 rotatable on the guide shaft 12, a pin belt 16 with a plurality of pins 15*a* being rotatably engaged between the drive pulley 13 and the follower pulley 14.

Figure 2:
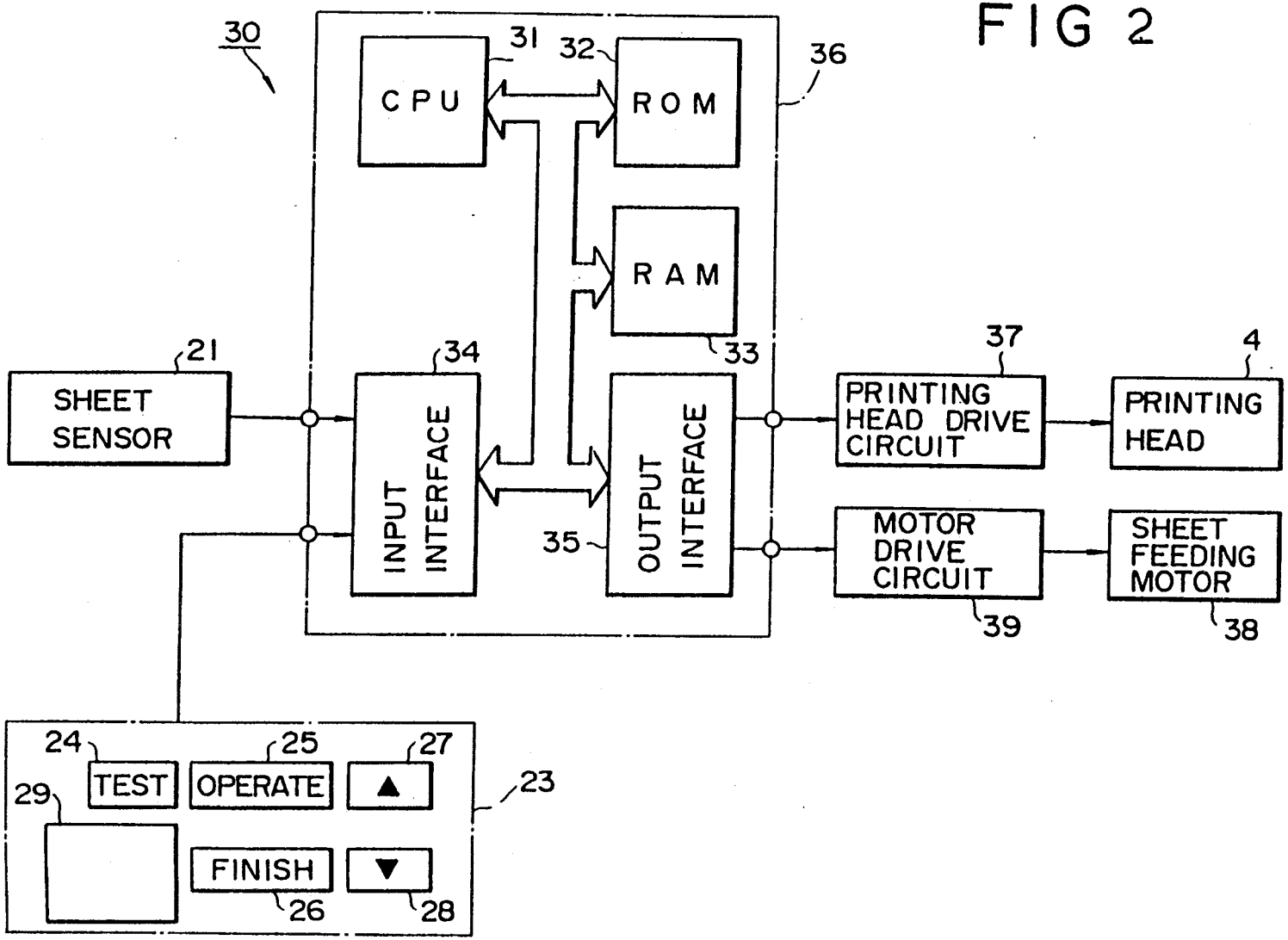
FIG. 2 is a structural diagram showing an electronic control unit and a surrounding section of one embodiment of a printing device according to the present invention.

When the transfer shaft 11 is rotated by a sheet feed motor 38, illustrated in FIG. 2, while the feed holes of the printing sheet "P" are engaged with the pins 15*a* of the pin belt 16, the pin belt 16 is rotatably moved and thereby the feed force is applied to the printing sheet "P" as the pins 15*a* rotatably move.

The printing device according to the present embodiment is provided with various sensors. Below the sheet guide member 6 upstream of the platen 2, an optical sheet sensor 21 for detecting whether or not the printing sheet "P" is set is mounted on the printer frame 1 by means of a bracket 22. A transparent hole 6a according to the sheet sensor 21 is formed on the sheet guide member 6. The sheet sensor 21 detects whether or not the printing sheet "P" is set via the transparent hole 6a. The sheet sensor 21 also detects the leading edge of the printing sheet "P" which passes on the transparent hole 6a. The position at which the leading edge of the printing sheet "P" is detected by the sheet sensor 21 refers to the reference position.

Besides a power switch, not shown, other various switches are provided. As switches for setting the print start position of the printing sheet "P", which specifically structure the present embodiment, as illustrated in FIG. 2, a test mode switch 24 for entering the print start position setting mode of the printing sheet "P", a run switch 25 for starting this process, an end switch 26 for ending this process, an lip switch 27 and a down switch 28 for setting the print start position, an LCD (Liquid Crystal Display) device 29 for displaying the print start position, and so forth are provided.

The detection signals of the above sensors and the output signals from the switches are processed by a signal processing circuit 30. The signal processing circuit 30 is chiefly structured with an electronic control device 36 comprising a known CPU (Central Processing Unit) 31, a known ROM (Read Only Memory) 32, a known RAM (Random Access Memory) 33, a known input interface 34, and a known output interface 35, the output circuit being provided with a print head drive circuit 37 and a motor drive circuit 39 for driving a sheet feed motor 38.

Figure 3:
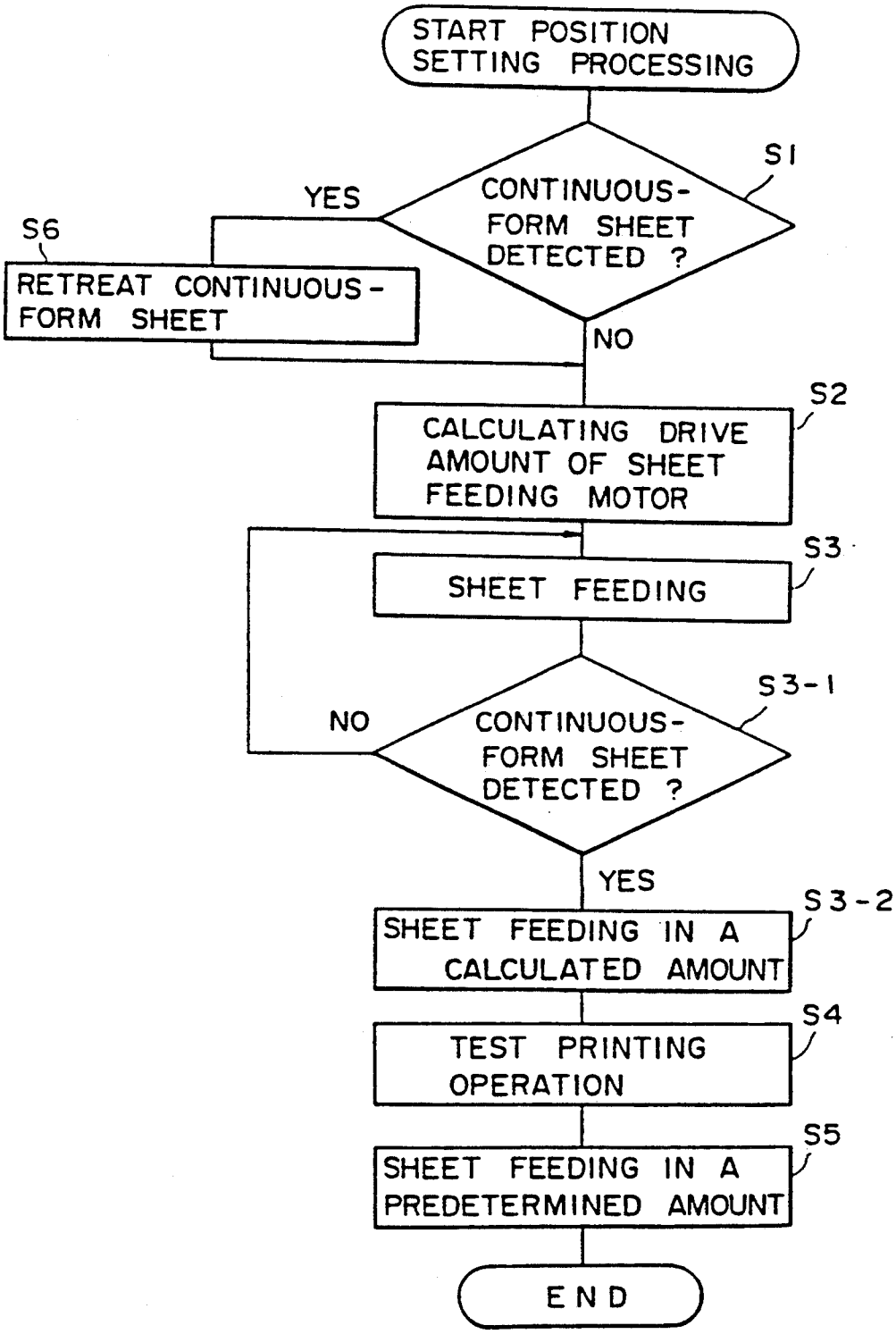
FIGS. 3 and 4 are flow charts showing a print start position setting process employed in the printing device according to the present invention.
Figure 4:
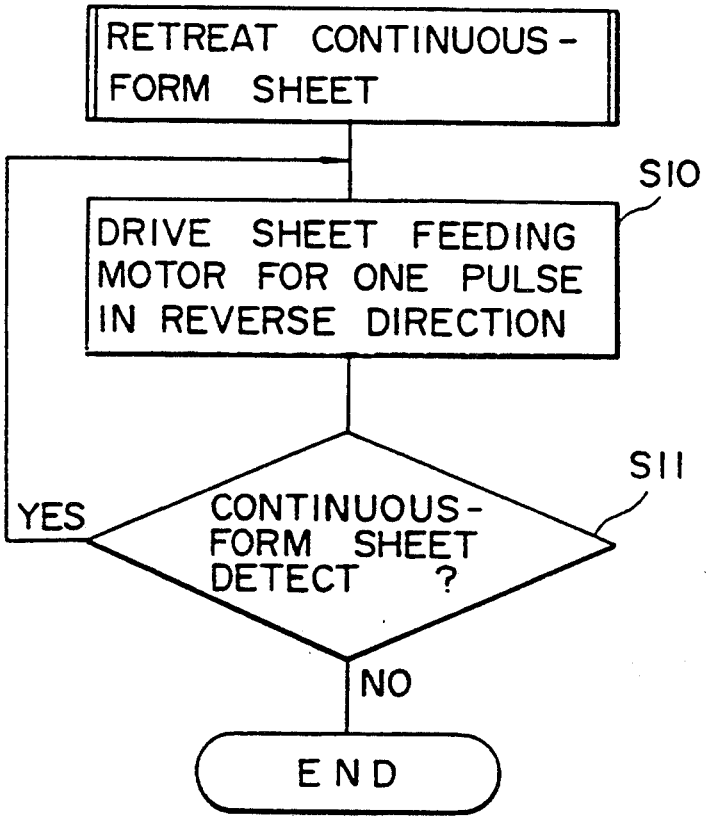

Referring to FIGS. 3 and 4, the print start position setting process of the printing sheet "P" executed according to the present embodiment will be described, each step being abbreviated as "S" in the following description.

While the printing sheet "P" is set to the printer in a ready position where the leading edge in the sheet feed direction is positioned at the center between the pin tractors 10 and the sheet sensor 21, when the test mode switch 24 is pressed, the setting value of the print start position stored in the RAM 33 is displayed on the LCD device 29. This setting value represents an incremental/decremental value to the reference value stored in the ROM 32. The value is indicated as ±N (where N is a positive integer, including 0) on the LCD device 29. The reference value is the driving amount of the sheet feed motor 38 necessary for moving the standard print start position to the position opposed to the print head 4. In other words, the reference value is the drive amount of the sheet feed motor 38 necessary for feeding the printing sheet "P" in the reference position to the position opposed to the print head 4.

To set the print start position of the sheet "P", while observing the setting value displayed on the LCD device 29, the operator operates the up switch 27 and/or down switch 28 when necessary.

Whenever the up switch 27 or down switch 28 is operated, the setting value displayed on the LCD device 29 is incremented or decremented. When this setting value is incremented by 1, the print start position goes away for 1/360 inch from the leading edge of the sheet "P". When this setting value is decremented by 1, the print start position comes close for 1/360 inch to the leading edge. After the setting value becomes the desired value, when the operator presses the run switch 25, the setting value displayed on the LCD device 29 is stored in the RAM 33 as a new setting value and the print start position setting process of the sheet "P" shown in FIG. 3 is executed.

First, in S1, it is determined whether or not the sheet "P" is set according to the detection signal from the sheet sensor 21. When it is determined that the sheet "P" is not set, the process advances to S2. In S2, the setting value of the print start position which is set by the operator is read from the RAM 33 and the driving amount of the sheet feed motor 38 according to the setting value is added or subtracted to or from the reference value which has been set in advance. In S3, the drive signal for commanding the sheet feed motor 38 to feed the sheet "P" for the driving amount computed in S2 is output. Thus, the pin tractor 10 is started to be drive to feed the sheet "P" and the sheet "P" is further sent from the reference position where the leading edge of the sheet "P" is detected by the sheet sensor 21 in S3-1, and fed to the position where the desired print start position is opposed to the print head 4 in S3-2 based upon the set value having been set in S2. In S4, the test print is executed on the sheet "P" in the position. In the test print operation, a predetermined mark such as "□" or "H" is printed 10 times in succession. With this test print, the print start position can be easily and securely checked at a short time.

In S5, the drive signal is sent to the sheet feed motor 38 so as to feed the sheet "P" till a boundary position between the form on which the predetermined mark is printed and the successive form is located at the cutter 17. The sheet "P" is perforated for each form. With this sheet feed operation, the sheet "P" is fed until the perforated position is opposed to the cutter 17. In the ROM 32, the data, relating to an amount of feeding operation till a first perforation of the sheet "P" is opposed to the cutter 17 after the detection of the leading edge of the sheet "P", are stored in advance. In the RAM 33, a counter for counting a feeding amount of the sheet "P" after the detection is provided. When a counted value of the counter becomes identical with the data having been the above data stored in the ROM 33, the feeding operation of the sheet "P" is ceased. Thus, the first perforation after the detecting operation is opposed to the cutter 17. Further, it may be considered that the sheet "P" is fed in an amount corresponding to length of one form of the sheet "P" after the predetermined printing operation. Thus, the printing operation can be executed from the position corresponding to the set value set at S2 on the successive form.

After the operator manually cuts the sheet "P" by the cutter 17 and he or she determines that the test print marks are printed in the desired positions of the sheet "P", by pressing the end switch 26, the mode is changed to the normal print mode. To change the print start position, the operator uses the up switch 27 and the down switch 28.

When the setting position is changed with the up switch 27 and the down switch 28 and then the run switch 25 is pressed, the process is repeated from S1. In this state, the sheet "P" is sent to the position where the leading edge of the sheet "P" is positioned nearby the cutter 17. Thus, since in S1 it is determined that the sheet "P" is set according to the signal from the sheet sensor 21, the process is advanced to S6. In S6, the sheet feed motor 38 is reversely driven and the process for retreating the sheet "P" to an upstream position of the reference position shown in FIG. 4 is executed. In other words, in the processes of S10 and S11 shown in FIG. 4, the drive signal is sent to the sheet feed motor 38 pulse by pulse, the sheet feed motor 38 being reversely rotated, the sheet "P" being retreated until the sheet sensor 21 does not detect the sheet "P". After that, the processes of S2 to S5 are executed. In other words, by repeating the process for computing the driving amount of the sheet feed motor 38 necessary for feeding the position where the desired print start position is opposed to the print head 4 and the test print process, the print start position of the sheet "P" is set to the desired position.

Thus, according to the present embodiment, to check the print start position of the sheet "P", by inputting the desired setting value with the up switch 27 and the down switch 28 and then pressing the run switch 25, the test print operation is executed in the setting position on the sheet "P". After that, the sheet "P" is sent to the position opposed to the cutter 17. Thus, the print position can be checked and the sheet "P" can be cut with simple operations. In addition, since the test print can be executed in a short time, the print start position can be quickly checked.

From the result of the test print, when it is necessary to adjust the print start position once again, by pressing the run switch 25, the sheet "P" is retreated to the reference position. Thus, by pressing the run switch 25, the similar test print is conducted and thereby the print start position can be easily readjusted. In other words, with the simple operations of inputting the print start position and of pressing the run switch 25, the print start position of the tractor sheet "P" can be checked once again.

In addition, according to the present embodiment, when the print start position of the sheet "P" is set, the data according to the setting is stored in the printer. Thus, when another print start position data is newly set, the stored data can be used. Consequently, it is not necessary to set the start position data from an external host computer and the like, to start the test print, and to conduct complicated operations such as print command operation and sheet feed operation which are necessary when data is not printed in the desired position.

In addition, since it is possible to set the print start position of the sheet "P" on the printer alone, it is not necessary to change the print start position according to each application software package and thereby the operability is improved.

What is claimed is:

1. A printing device, capable of employing at least a continuous-form printing sheet successively having a plurality of printing forms along a predetermined direction, comprising a printing unit for executing a printing operation on a printing sheet, and a sheet feeding unit for feeding the printing sheet along said predetermined direction at least toward a position at which said printing unit is located, said printing device further comprising:

printing start position setting means for inputting data representative of a print start position on said printing sheet without moving said printing sheet, said position being spaced apart from a first leading edge of the printing sheet;

detecting means, provided at a point upstream of said printing unit for detecting if said printing sheet is at said point;

first controlling means for controlling said sheet feeding unit so at to reversely feed the printing sheet while said first leading edge of said printing sheet is detected by said detecting means;

second controlling means for controlling said sheet feeding unit so as to forwardly feed the printing sheet toward said printing unit until said first leading edge of said printing sheet is detected by said detecting means;

third controlling means for controlling said sheet feeding unit so as to further feed the printing sheet in accordance with data inputted by said printing start position setting means so that the print start position is located at said printing unit;

print controlling means for controlling said printing unit so as to execute a test printing operation when the print start position having been set by said print start position setting means is located at said printing unit;

cutting means downstream of said printing unit;

fourth controlling means for controlling said sheet feeding unit so as to feed said printing sheet forwardly until a boundary position between a form on which said printing operation is executed and the next successive form is positioned at said cutting means with a second leading edge, said first controlling means retracting said sheet until said second leading edge is detected by said detecting means;

whereby said test printing operation is executed on the print start position, so that a positional relation between said print start position and the leading edge of the printing sheet is represented on said printing sheet and thereafter the printing sheet is fed so that said boundary is located at said cutting means.

2. The printing device according to claim 1, wherein said detecting means comprises an optical sensor provided at said predetermined point capable of sensing an existence of the printing sheet.

3. The printing device of claim 1 wherein said print start position setting means includes a mode selecting means for selecting one of an operating and a test mode, wherein in said operating mode forms are printed on said sheet and in said test mode one print start position is selected for said one form, and after said first form is separated from said sheet another start position is selectable for said next form, said print start positions being selected without moving said sheet.

4. A printing device for printing successively a plurality of forms on a continuous sheet comprising:

a printing unit;

a print feeding unit for feeding said sheet toward said printing unit;

print start position setting means for inputting data by an operator representative of a print start position on said sheet, said print start position being selected with respect to a first leading edge of said sheet without moving said sheet;

detecting means for detecting said first leading edge, said detecting means being disposed upstream of said printing unit;

first control means for controlling said print feeding unit for moving said sheet until said detecting means detects said first leading edge;

second control means for advancing said sheet from a first position in which said first leading edge is positioned at said detecting means until said print start position is disposed adjacent to said printing unit;

print control means for printing a test character at said print start position;

cutting means for cutting said sheet after printing; and third control means for feeding said sheet from said printing unit to said cutting means until a boundary position between one form and a next form is positioned at said cutting means, said cutting means being used to cut off said one form at said boundary position to define a second leading edge, said first control means being further provided to retract said sheet until said detecting means detects said second leading edge.

5. The printing device of claim 4 wherein said print start position setting means includes a mode selecting means for selecting one of an operating and a test mode, wherein in said operating mode forms are printed on said sheet and in said test mode said print start position is set.

6. The printing device of claim 4 wherein said print start position setting means includes print start initiating means for activating said control means after said print start position has been selected by an operator.

7. The printing device of claim 4 further comprising printing control means for printing with said printing unit a plurality of predetermined characters during a printing operation.

8. The printing device of claim 4 wherein said test print control means prints a number of predetermined test characters.

9. The printing device of claim 8 wherein said number of predetermined test characters form a test pattern printed across said sheet.

10. The printing device of claim 4 wherein said print start position setting means includes a mode selecting means for selecting one of an operating and a test mode, wherein in said operating mode forms are printed on said sheet and in said test mode one print start position is selected for said one form, and after said first form is separated from said sheet another start position is selectable for said next form, said print start positions being selected without moving said sheet.

11. The printing device of claim 4 wherein said test character is printed on said one form.

12. The printing device of claim 4 wherein said data is incremented by said operator.

13. A method of operating a printing device for printing successive forms on a continuous sheet, said printing device having a memory means for storing data indicative of a preselected print start position, a sheet cutter and adjusting means for incrementally adjusting said preselected print start position, said method comprising the steps of:

selecting an actual print start position by changing said data by an incremental amount without moving said sheet;

moving said sheet until a leading edge of said sheet is detected at a detection position;

advancing said sheet from said detection position to a printing station;

printing a test pattern at said actual print start position on said sheet;

advancing said sheet to said cutter until a border between two forms is reached at said cutter;

separating a form with said print pattern from said sheet with said cutter; and retracting said sheet after said form is separated until a new leading edge is detected at said detection station.

14. The method of claim 13 wherein said printing device has a print mode and a test mode of operation, and wherein in said test mode after said form is separated, another print start position is selectable without moving said sheet.

15. The method of claim 13 wherein said data is selected by incrementally increasing said preselected start position.

16. The method of claim 13 wherein said data is selected by incrementally decreasing said preselected print start position.

17. The method of claim 13 wherein said test pattern consists of a plurality of test characters printed across said sheet.

* * * * *